US005544883A

United States Patent [19]

Meyer

[11] Patent Number: 5,544,883

[45] Date of Patent: Aug. 13, 1996

[54] FACE-BALANCED PUTTER WITH OFFSET HOSEL

[75] Inventor: Dean E. Meyer, LaGrange Park, Ill.

[73] Assignee: Wilson Sporting Goods Co., Chicago, Ill.

[21] Appl. No.: 515,862

[22] Filed: Aug. 16, 1995

[51] Int. Cl.[6] ..... A63B 53/02; A63B 53/04

[52] U.S. Cl. ..... 473/313; 473/341; 473/252

[58] Field of Search ..... 273/167 R, 167 G, 273/80 C, 164.1, 169, 167 F, 167 J, 80 A, 80 R, 80.1, 80.2, 167 D, 167 B, 77 R, 81.3; D21/214, 215, 216, 217, 218, 219, 220

[56] References Cited

U.S. PATENT DOCUMENTS

| | | | |
|---|---|---|---|
| D. 221,446 | 8/1971 | Cook . | |
| D. 228,930 | 10/1973 | Leigh | 273/167 G |
| D. 258,377 | 2/1981 | Nordness . | |
| D. 313,451 | 1/1991 | Shearer | D21/219 |
| D. 322,829 | 12/1991 | Antonious | 273/167 G X |
| D. 360,669 | 7/1995 | Buscemi | D21/219 |
| 2,820,638 | 1/1958 | Morrison | 273/80 C |
| 3,567,227 | 3/1971 | Panks | 273/80 C |
| 3,923,308 | 12/1975 | Mills . | |
| 3,954,265 | 5/1976 | Taylor . | |
| 4,265,452 | 5/1981 | Vella . | |
| 4,411,429 | 10/1983 | Drew . | |
| 4,693,478 | 9/1987 | Long . | |
| 4,747,599 | 5/1988 | Antonious | 273/167 G |
| 4,832,340 | 5/1989 | Pickering . | |
| 4,852,879 | 8/1989 | Collins | 273/164.1 |
| 4,948,140 | 8/1990 | Antonious . | |
| 5,016,882 | 5/1991 | Fujimura | 273/169 |
| 5,078,398 | 1/1992 | Reed . | |
| 5,160,141 | 11/1992 | Crews . | |
| 5,209,474 | 5/1993 | Voyer . | |
| 5,226,654 | 7/1993 | Solheim | 273/80 A |
| 5,267,733 | 12/1993 | Szokola . | |
| 5,273,282 | 12/1993 | Cannon . | |
| 5,290,035 | 3/1994 | Hannon . | |

FOREIGN PATENT DOCUMENTS

| | | | |
|---|---|---|---|
| 1232651 | 5/1971 | United Kingdom | 273/80 C |

*Primary Examiner*—Sebastiano Passaniti

[57] ABSTRACT

A face-balanced putter includes an offset hosel which is configured to permit top line alignment between the putter and a golf ball. The hosel includes a bottom portion which extends upwardly from the heel portion of the putter, a forwardly extending portion which extends forwardly beyond the face of the putter, a laterally extending portion which is postioned forwardly of the face, and a socket for supporting a shaft.

15 Claims, 1 Drawing Sheet

FACE-BALANCED PUTTER WITH OFFSET HOSEL

BACKGROUND

This application relates to a face-balanced putter with an offset hosel, and, more particularly, to such a putter which permts topline alignment.

Face-balanced putters are well known and have been available for many years. Such putters are described, for example, in U.S. Pat. Nos. 5,290,035, 5,226,654, 5,078,398, 4,852,879, 3,954,265, 2,820,638, and Des. 221,446. In a face-balanced putter the axis of the shaft intersects the center of gravity of the putter head or intersects a line which extends through the center of gravity perpendicularly to the face.

A desirable objective in designing a putter, whether face-balanced or not, is to allow top line alignment. The top line of the putter, i.e., the upper edge of the face, should be square or perpendicular to the intended line of the putt. It is therefore desirable, in designing a putter, to allow the golfer to view as much of the top line as possible when addressing the ball, particularly the portion of the top line which is behind the golf ball.

Another well known type of putter is an offset hosel putter. Such putters are described, for example, in U.S. Pat. Nos. 5,226,654, 4,948,140, 4,852,879, 4,832,340, 4,693, 478, 4,265,452, 3,954,265, 3,923,308, and Des. 221,446. In a putter with an offset hosel the shaft is positioned forwardly of the face, i.e., an extension of the centerline of the shaft would not intersect the putter head and would pass forwardly of the face of the putter.

Because an offset hosel extends forwardly of the top line of the putter, the hosel of most offset hosel putters is connected to the putter head close to the heel end of the putter head so that the top line behind the holf ball is visible to the golfer at address. As a result, the centerline of the shaft does not intersect a line which extends through the center of gravity perpendicularly to the face.

Because the shaft of most face-balanced putters is positioned farther away from the heel than the shaft of most non-face-balanced putters, many face-balanced puttes do not use an offset hosel so that the top line behind the ball is not obstructed. For example, U.S. Pat. No. 5,078,398 states:

> "In the preferred embodiment, the position and alignment of the hosel barrel 34 and the hosel stem 32, relative to the putter head body portion 28, are such that the putter 20 has a slight onset-type design. That is, it is one where the putter's leading edge (face 42 ) is in front of the hosel 30 and shaft 22 (See FIGS. 4, 5, 6, and 9). Thus, the advantages provided by the present invention's putter (i.e., allowing the putter to be infinitely balanced coupled with a high moment of inertia) are achieved without having the putter's shaft and hosel obstructing the view of the striking face and the ball at address and ball impact positions." (col. 7, lines 25–36)

Prior face-balanced putters with an offset hosel do not permit optimum top line alignment because the hosel is positioned too far from the heel and obstructs a portion of the top line behind the ball. This can be seen, for example, in U.S. Pat. Nos. 5,226,654, 4,852,879, and Des. 221,446.

SUMMARY OF THE INVENTION

The invention provides a face-balanced putter with an offset hosel which does not interfere with top line alignment. The hosel is connected to the putter head near the heel of the putter head, and the forwardly extending offset portion of the hosel does not obstruct the portion of the top line which is behind the golf ball. Even though the hosel is connected to the putter head near the heel, face balancing is obtained by incorporating a laterally extending portion in the hosel which extends parallel to the face toward the toe. The laterally extending portion is positioned forwardly of the face so that it does not obstruct the top line and permits the shaft to be mounted in a face-balanced position.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
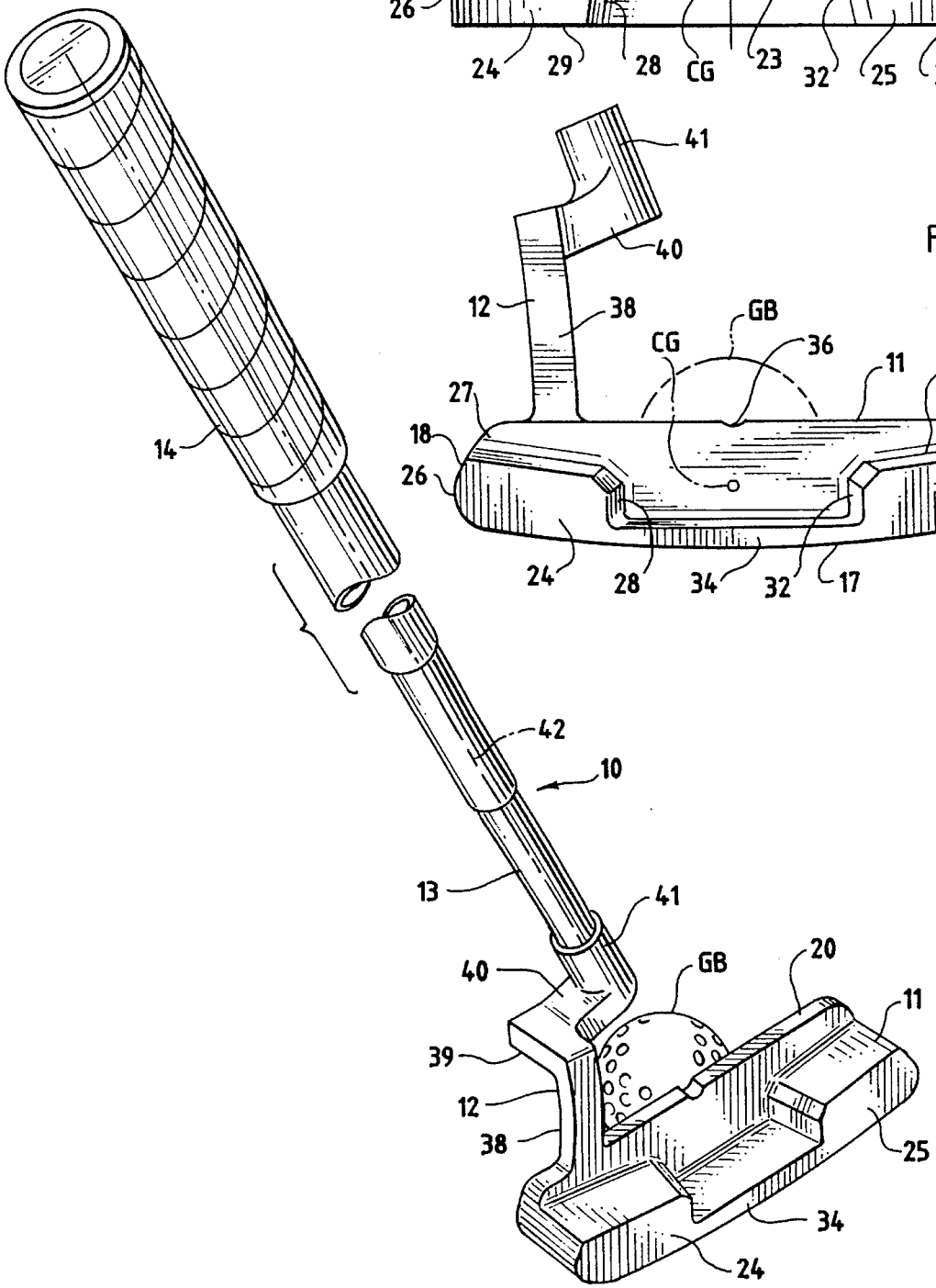
FIG. 1 is a perspective view of a putter formed in accordance with the invention.
Figure 3:
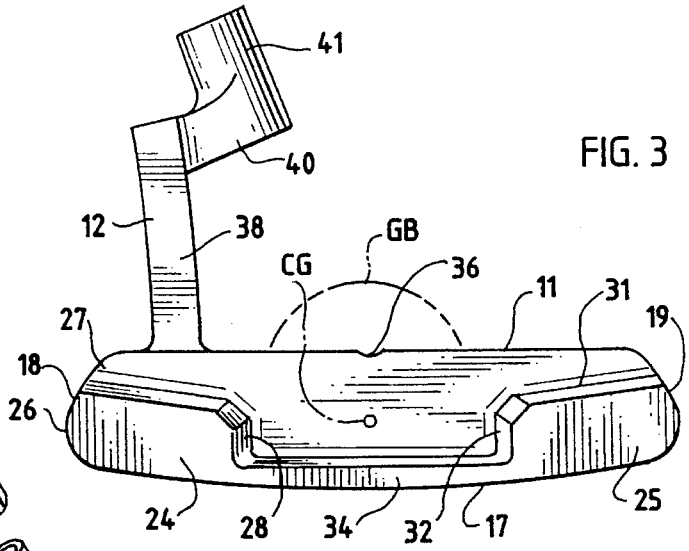
FIG. 3 is a rear view of the putter head.

Referring to FIG. 1, a putter 10 includes a putter head 11, a hosel 12, and a shaft 13. The top end of the shaft includes a conventional grip 14.

With the exception of the hosel 12, the putter head 11 can have any conventional shape. However, the preferred shape is a heel and toe weighted shape of the type shown in the drawings.

The putter head includes a flat or substantially flat face 16, a sole or bottom surface 17, a heel end 18, and a toe end 19. The sole extends rearwardly from the bottom edge of the face, and a narrow top surface 20 extends rearwardly from the top edge of the face. The intersection between the face and the top surface provides a top line 21.

A back surface 23 extends downwardly from the top surface generally parallel to the face 16 and provides a relatively thin wall behind the central portion of the face which strikes the golf ball.

A heel weight portion or block 24 extends upwardly from the sole in the heel portion of the putter head, and a toe weight portion or block 25 extends upwardly in the toe portion. The heel weight includes a heel end surface 26, a top surface 27, an inside surface 28, and a rear surface 29. Similarly, the toe weight includes a toe end surface 30, a top surface 31, an inside surface 32, and a rear surface 33. The inside surfaces 28 and 32 are spaced from the center of the putter head to provide a relatively thin central sole portion 34.

The center of gravity of the putter head is indicated by the circle CG and lies behind the back surface 23 and above the central portion 34 of the sole. It is desirable to strike a golf ball with a point on the face which lies in a plane which passes through the center of gravity perpendicularly to the face. A conventional alignment groove 36 in the top surface 20 also lies in that plane.

The hosel 12 is preferably formed integrally with the putter head, and the weight of the hosel is included in determining the location of the center of gravity CG. The hosel includes a bottom portion 38 which is connected to the top surface 20 and extends generally straight upwardly therefrom. A forwardly extending portion 39 extends forwardly from the top of the bottom portion generally perpendicularly to the bottom portion. A laterally extending portion 40 extends laterally from the forwardly extending portion 39 toward the toe in a direction which is generally parallel to the plane of the face 16. A socket 41 is mounted on the laterally extending portion, and the bottom of the shaft 13 is inserted into the socket.

The socket is angled so that the centerline or axis 42 of the shaft and the socket passes through a line 43 which is formed by the intersection of a horizontal plane which passes through the center of gravity CG and a vertical plane which passes through the center of gravity perpendicularly to the face 16. The horizontal plane is parallel to a plane which is tangent to the center of the sole 17, often called the ground plane because it coincides with the ground when the putter is soled as designed. The horizontal plane is also generally perpendicular to the face 16. However, because the face usually has a slight loft angle, the face might not be precisely vertical. The vertical plane is perpendicular to the ground plane.

The laterally extending portion 40 of the hosel has a centerline which extends generally parallel to the horizontal plane and the face plane. However, the portion 40 might be inclined upwardly somewhat to accommodate the tilt of the socket 41. The forwardly extending portion 40 has a centerline which extends generally perpendicularly to the face plane and generally parallel to the vertical plane. The bottom portion 38 of the hosel has a centerline which extends generally parallel to the face plane.

Figure 2:
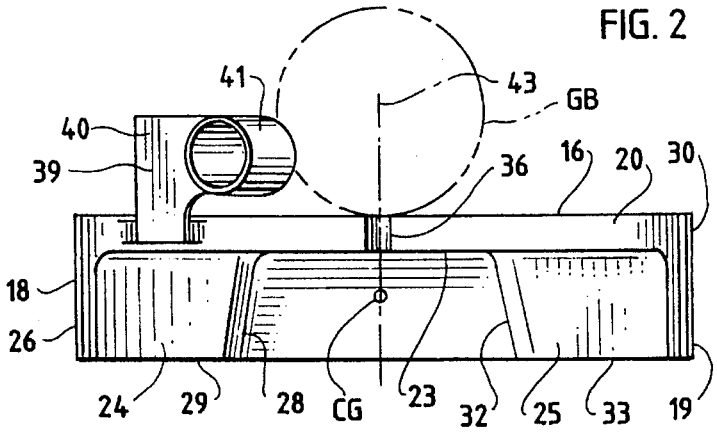
FIG. 2 is a top view of the putter head.

Referring to FIGS. 1 and 2, the bottom portion 38 of the hosel and the forwardly extending portion 40 are positioned close to the heel end 18. The laterally extending portion 40 and the socket 41 are positioned forwardly of the face 16 and top line 21 as viewed by the golfer when addressing a golf ball GB. Accordingly the entire portion of the top line which is behind the golf ball can be seen by the golfer. The golfer can therefore use the entire top line behind the ball for alignment.

In the preferred embodiment, the bottom portion 38 of the hosel extends upwardly from the putter head at a position which is spaced toward the heel from the inside surface 28 of the heel weight 24. In the embodiment illustrated, the bottom portion 38 is about midway between the inside surface 28 and the heel end surface 26.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A golf putter comprising:

a putter head having a substantially flat face with a top edge and a bottom edge, a sole portion extending rearwardly from the bottom edge of the face, a toe portion, and a heel portion, a hosel mounted on the putter head and having a bottom portion which extends generally upwardly from the putter head adjacent the heel portion, a forwardly extending portion which extends forwardly from the bottom portion of the hosel beyond the face of the putter head, a laterally extending portion which extends from the forwardly extending portion toward the toe portion in a direction generally parallel to the face, the laterally extending portion being positioned forwardly of the face, and a shaft-attaching portion connected to the laterally extending portion, and a shaft attached to the shaft-attaching portion of the hosel and extending generally upwardly therefrom.

2. The putter of claim 1 in which the putter head has a center of gravity, the sole portion has a midportion below the center of gravity, and the shaft has an axis which intersects a line formed by the intersection of a first plane which extends through the center of gravity and which is parallel to a plane which is tangent to the midportion of the sole and a second plane which passes through the center of gravity and which is perpendicular to the first plane.

3. The putter of claim 1 in which the shaft-attaching portion of the hosel is a socket and the shaft is inserted into the socket.

4. The putter of claim 1 in which the forwardly extending portion of the hosel has a centerline which lies in a plane which is generally perpendicular to the plane of the face.

5. The putter of claim 4 in which the laterally extending portion of the hosel is generally perpendicular to the forwardly extending portion of the hosel.

6. The putter of claim 1 in which the putter head includes a top surface which extends rearwardly from the top edge of the face and the bottom portion of the hosel is connected to the top surface.

7. The putter of claim 1 in which the putter head includes a toe end, a heel end, a heel weight which extends upwardly from the sole in the heel portion of the putter head, and a toe weight which extends upwardly from the sole in the toe portion, the heel weight having an outside end surface at the heel end of the putter head and an inside end surface, the toe weight having an outside end surface at the toe end of the putter head and an inside end surface, the inside end surfaces of the heel and toe weights being separated by a relatively thin central portion of the sole, the bottom portion of the hosel being connected to the putter head between the inside and outside end surfaces of the heel weight.

8. The putter of claim 7 in which the bottom portion of the hosel is connected to the putter head substantially midway between the inside and outside end surfaces of the heel weight.

9. The putter of claim 7 in which the putter head includes a top surface which extends rearwardly from the top edge of the face and the bottom portion of the hosel is connected to the top surface.

10. The putter of claim 7 in which the putter head has a center of gravity, the sole portion has a midportion below the center of gravity, and the shaft has an axis which intersects a line formed by the intersection of a first plane which extends through the center of gravity and which is parallel to a plane which is tangent to the midportion of the sole and a second plane which passes through the center of gravity and which is perpendicular to the first plane.

11. The putter of claim 10 in which the forwardly extending portion of the hosel has a centerline which lies in a plane which is generally perpendicular to the plane of the face.

12. The putter of claim 11 in which the laterally extending portion of the hosel is generally perpendicular to the forwardly extending portion of the hosel.

13. The putter of claim 1 in which the putter head has a midportion and the bottom portion of the hosel is connected to the putter head at a location which is spaced from the midportion of the putter head by a distance which is substantially greater than the radius of a golf ball.

14. The putter of claim 13 in which said distance is about twice the radius of a golf ball.

15. The putter of claim 1 in which the length of the upwardly extending bottom portion of the hosel is less than the diameter of a golf ball.

* * * * *